US007334866B2

(12) United States Patent
Izawa et al.

(10) Patent No.: US 7,334,866 B2
(45) Date of Patent: Feb. 26, 2008

(54) LINE HEAD CHASSIS DETACHABLY ATTACHING JIG IN AN INKJET RECORDING APPARATUS

(75) Inventors: Hideo Izawa, Narashino (JP); Akira Ishikawa, Narashino (JP)

(73) Assignee: Miyakoshi Printing Machinery Co., Ltd., Narashino (JP)

( * ) Notice: Subject to any disclaimer, the term of this patent is extended or adjusted under 35 U.S.C. 154(b) by 0 days.

(21) Appl. No.: 11/591,107

(22) Filed: Nov. 1, 2006

(65) Prior Publication Data

US 2007/0109350 A1 May 17, 2007

(30) Foreign Application Priority Data

Nov. 16, 2005 (JP) ..... 2005-331017

(51) Int. Cl.
*B41J 23/00* (2006.01)

(52) U.S. Cl. ..... 347/37

(58) Field of Classification Search ..... 347/37, 347/49

See application file for complete search history.

(56) References Cited

U.S. PATENT DOCUMENTS 5,293,179 A * 3/1994 Ichikawa et al. ..... 347/56

6,217,684 B1 * 4/2001 Morii et al. ..... 156/64

FOREIGN PATENT DOCUMENTS

JP 09-001789 1/1997

* cited by examiner

*Primary Examiner*—Anh T. N. Vo
(74) *Attorney, Agent, or Firm*—Cohen Pontani Lieberman & Pavane LLP

(57) ABSTRACT

To make a line head chassis detachable simply and easily in an inkjet recording apparatus, a jig for the line head chassis is provided which comprises: a first support member mounted on a table lateral to the inkjet head; a second support member mounted laterally to and lower than the first support member; a rail member mounted laterally to the first support member and having one end connected thereto; an upright support member having its lower end supported by the second support member adjustably in its height direction and its upper end connected to the other end of the rail member for supporting the rail member horizontally; a base table slidably supported on the rail member to move over a distance outward from a maintenance position; and a cradle means supported on the base table so as to be movable perpendicularly to a direction in which the base table moves for accepting the line head chassis, wherein one end of the rail member and the lower end of the upright support member are made engageable with/disengageable from the first and second support members, respectively.

2 Claims, 13 Drawing Sheets

LINE HEAD CHASSIS DETACHABLY ATTACHING JIG IN AN INKJET RECORDING APPARATUS

BACKGROUND OF THE INVENTION

1. Technical Field

The present invention relates to an inkjet recording apparatus having an inkjet head comprising a line head chassis having a plurality of unit heads each of which has numbers of ink nozzles and which are arranged in a line in a direction of width of a printable material and a controller housing that can be moved between a printing position and a maintenance position lateral to the printing position wherein the line head chassis can be attached to and detached from the controller housing. In particular, the invention relates to a line head chassis detachably attaching jig for use in detaching and attaching such a line head chassis from and to the controller housing at the maintenance position.

2. Description of the Prior Art

Attaching and detaching a line head chassis from a controller housing has hitherto been effected manually by an operator. See, for example, JP H09-1789 A.

In the prior art as mentioned above where the line head chassis is configured to be taken into and out of the controller housing at a fixed position in an inkjet head, the manual operation does not pose quite a problem. However, in the state that a controller housing has been moved to its maintenance position, the operation of manually detaching and attaching a line head chassis from and to the controller housing is becoming difficult as the line head chassis becomes large in weight.

SUMMARY OF THE INVENTION

With the above taken into account, it is an object of the present invention to provide a line head chassis detachably attaching jig in an inkjet recording apparatus which enables a line head chassis to be simply and easily detached from and attached to a controller housing in an inkjet head in the state that the inkjet head has been moved to its maintenance position.

In order to achieve the object mentioned above, the present invention provides, in an inkjet recording apparatus having an inkjet head comprising a controller housing that can be moved between a printing position and a maintenance position lateral to the printing position and a line head chassis that can be attached to and detached from the controller housing, a jig for the line head chassis characterized in that it comprises a first support member mounted on a table lateral to the inkjet head; a second support member mounted laterally to and lower than the first support member; a rail member mounted laterally to the first support member and having one end connected thereto; an upright support member having its lower end supported by the second support member adjustably in its height direction and its upper end connected to the other end of the rail member for supporting the rail member horizontally; a base table slidably supported on the rail member to move over a distance outward from the maintenance position; and a cradle means supported on the base table so as to be movable perpendicularly to a direction in which the base table moves for accepting the line head chassis, wherein one end of the rail member and the lower end of the upright support member are made engageable with/detachable from, the first and second support members, respectively.

According to the present invention, when in an inkjet recording apparatus a line head chassis is to be detached from and attached to a controller housing in an inkjet head therein, the controller housing may be moved laterally to the inkjet head and then the line head chassis may be placed onto the cradle means which may then be moved outwards to take it out. This eliminates the need for an operator to lean his/her body forward above the apparatus body to support the line head chassis and permits the line head chassis to be attached and detached easily in a simple operation and in a short period of time while improving the workability in maintenance and inspection of the line head chassis.

And, by eliminating the need for an operator to support the line head chassis and permitting the line head chassis removed to be freely moved together with the cradle means relative to the maintenance position, it is possible to prevent ink nozzle surfaces and the like of the line head chassis from suffering damages, e. g., upon contacting a part of the main body of the inkjet recording apparatus while preventing troubles from occurring in the maintenance of the integrity of the apparatus itself and the safety of the operator.

Further, according to the makeup mentioned above, by making the rail member and the upright support member engageable with/disengageable from the first and second support members, respectively, which are provided laterally to the inkjet head, it is possible, even in an inkjet recording apparatus equipped with a plurality of inkjet heads, when the first and second support members are in advance provided laterally to each inkjet head, to use all members except both these members for attaching and detaching a line head chassis in an inkjet head and then to economically use a set of jigs for any of the inkjet heads.

In the jig constructed as mentioned above, a head catch tray for accepting the line head chassis is preferably mounted on the cradle means so that the head catch tray can be engaged with and disengaged from the cradle means.

By mounting a catch tray for accepting the line head chassis on the cradle means so that the former can be engaged with and disengaged from the latter in this manner, it is possible to accept the line head chassis on the cradle means, thereby to facilitate moving the line head chassis removed from the controller housing.

DESCRIPTION OF THE PREFERRED EMBODIMENTS

Figure 1:
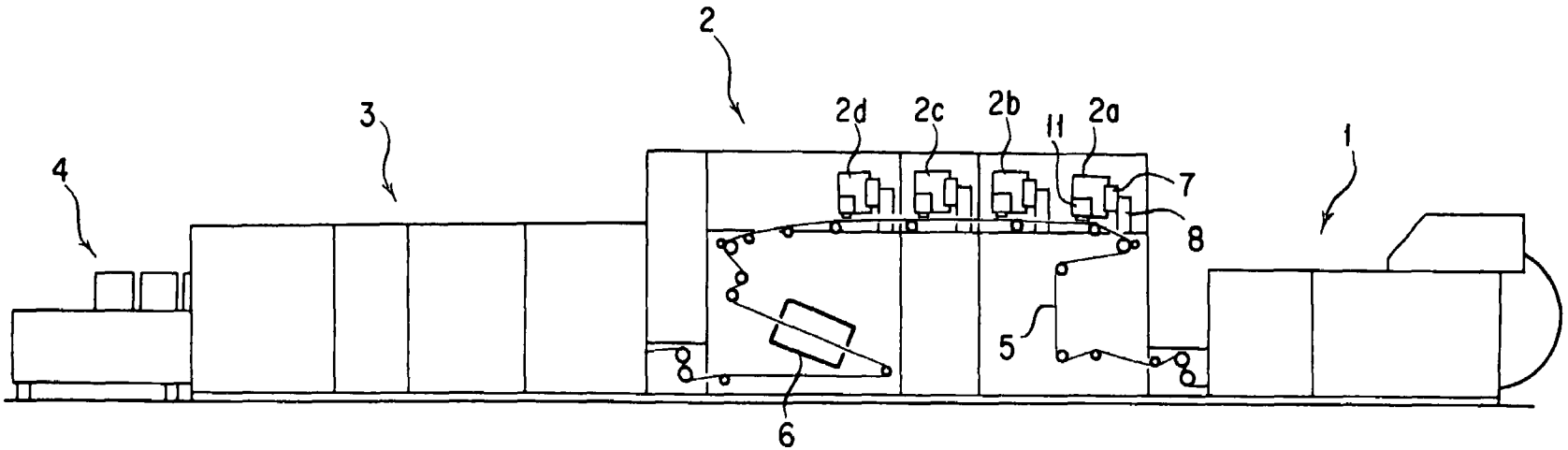
FIG. 1 is a front view of an inkjet recording apparatus in which the present invention is implemented, seen as a whole from the side of its prime mover.

FIG. 1 is a front view of an inkjet recording apparatus in which the present invention is implemented, seen as a whole from the side of its prime mover. In FIG. 1, the apparatus is shown to comprise a paper feeding section 1, a printing section 2, a machining section 3 and a paper delivery section 4. Paper 5 (to be printed) fed from the paper feeding section 1 is printed in the printing section 2 and after being at need dried by a drier 6 enters the machining section 3 where it is machined as necessary, and is then delivered to the paper delivery section 4.

The printing section 2 comprises a plurality of inkjet heads 2*a*, 2*b*, 2*c* and 2*d*, e. g., for yellow, for magenta, for cyanogens and for black, which are arranged in the order in the travel direction of the paper 5. And, the inkjet heads 2*a*-2*d* are supported by frames 8 via support units 7, respectively. Each of the support units 7 is provided with adjustment mechanisms known in the art for adjusting the vertical position of each inkjet head 2*a*, 2*b*, 2*c*, 2*d* relative to the supporting frame 8 and its posture relative to the paper 5, etc.

Figure 2:
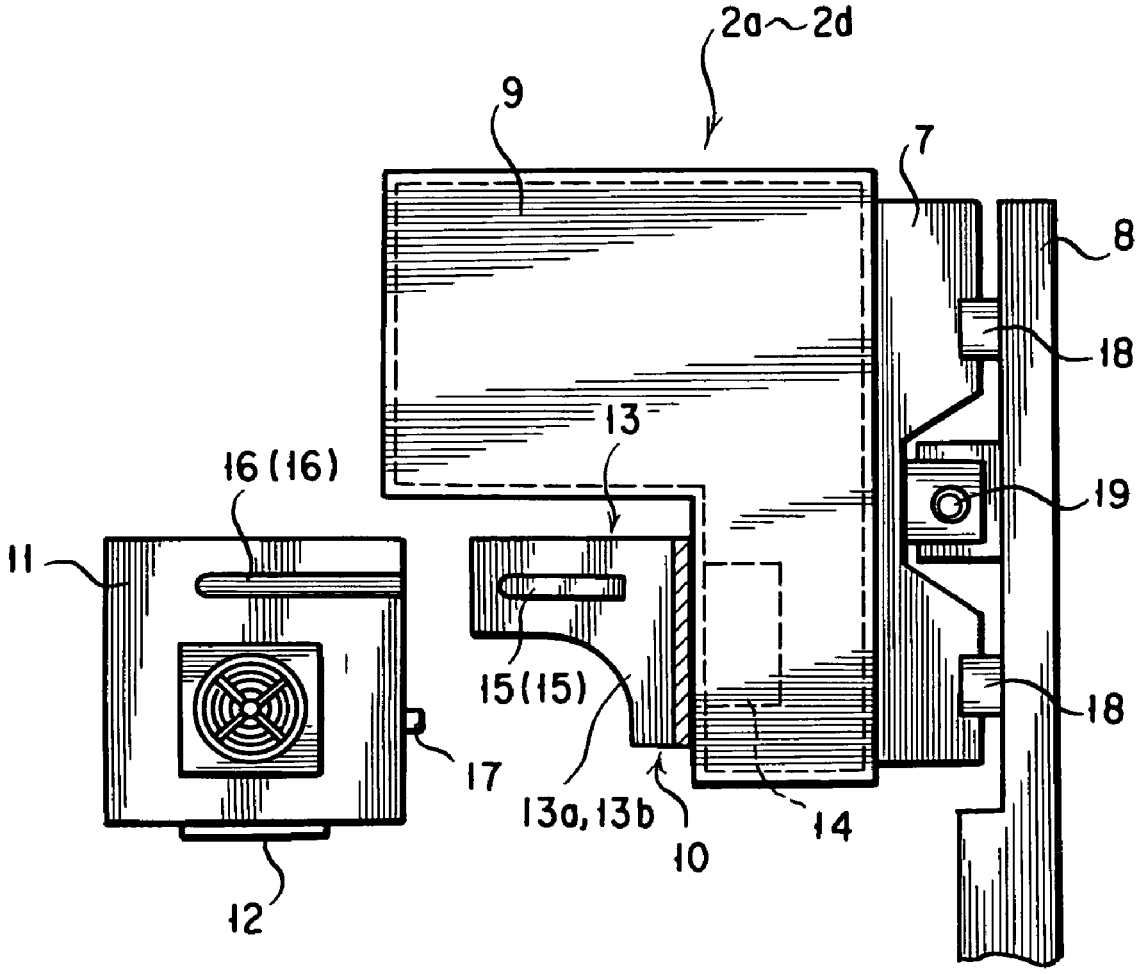
FIG. 2 is an explanatory view illustrating the makeup of an inkjet head in the inkjet recording apparatus of FIG. 1, shown as in part cut away and decomposed.

Each of the inkjet heads 2*a*-2*d* as shown in FIG. 2 comprises a controller housing 9 supported by the support frame 8 via the support unit 7, and a line head chassis 11 detachably attached via a support mechanism 10 to the controller housing 9 and provided at an under surface of the line head chassis 11 with a line head 12 having a plurality of unit heads arranged in a line.

The support mechanism 10 comprises a bracket 13 movable vertically with a selected stroke length relative to the controller housing 9, and an elevating unit 14 for vertically moving the bracket 13. The bracket 13 has a pair of arms 13*a* and 13*b* adapted to be opposed to both widthwise side surfaces of the line head chassis 13, respectively and is formed with horizontal keys 15 and 15 inside of the arms 13*a* and 13*b*, respectively.

On the other hand, the line head chassis 11 is formed in its widthwise side surfaces with a pair of grooves 16 and 16 which are adapted to mate with the keys 15 and 15, respectively. With the keys 15 and 15 made to mate with the grooves 16 and 16, the line head chassis 11 is engaged with and supported by the support mechanism 13. The line head chassis 11 is also provided with a positioning pin 17.

Figure 3:
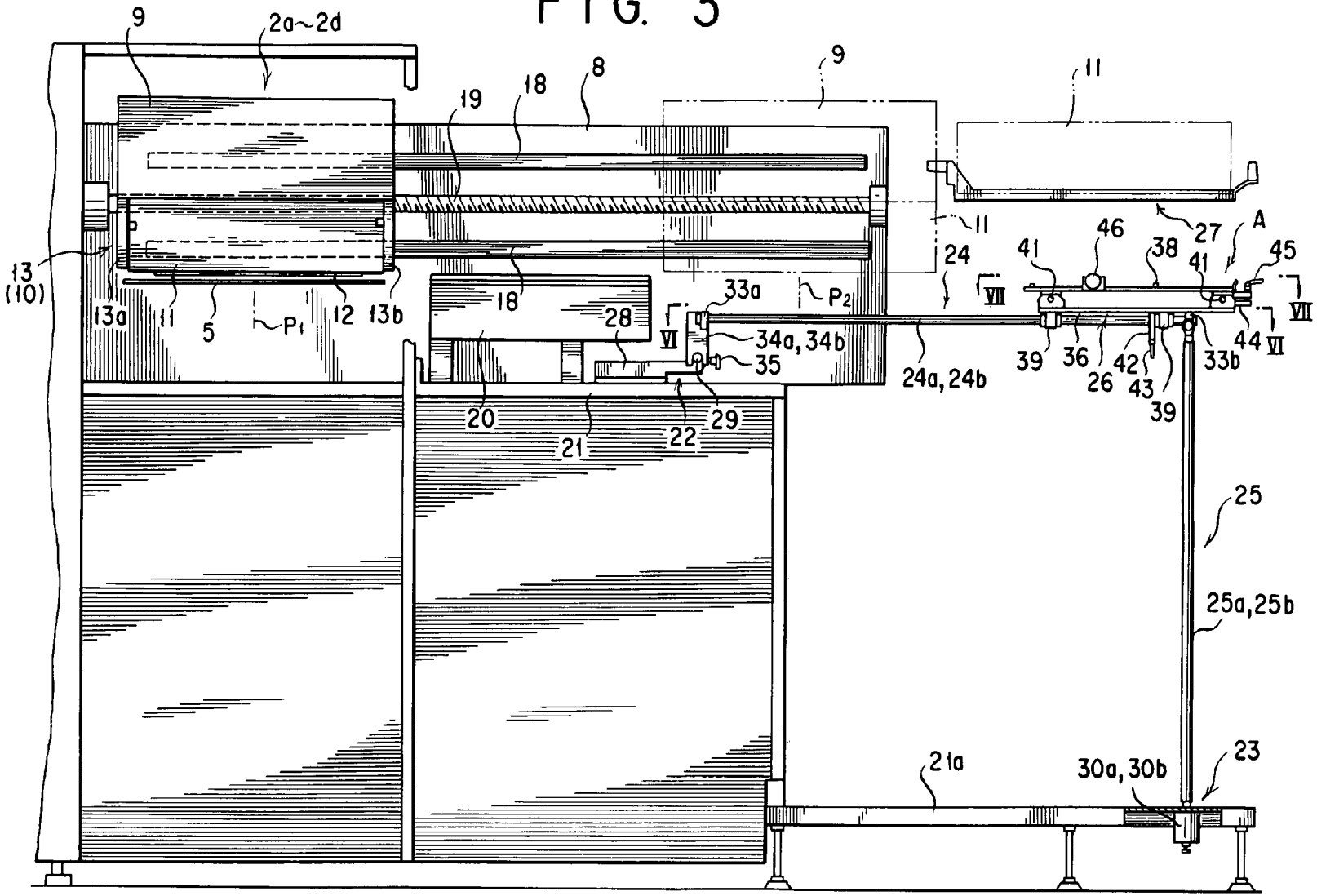
FIG. 3 is a side view illustrating a jig for attaching and detaching a line head chassis that represents one embodiment according to the present invention.

The support frame 8 for supporting the controller housing 9 via the support unit 7 as shown in FIGS. 2 and 3 is provided with rails 18 laid outwards towards the prime mover (at the right hand side in FIG. 3) and on which rails the support unit 7 is supported so that the controller housing 9 is movable horizontally over a distance between a printing position P1 at which it is opposite to the paper 5 and its maintenance position P2. The support frame 8 is also provided with a feed screw 19, which is in mesh with the support unit 7 and is driven by a drive unit (not shown) to move the controller housing 9 from the position P1 to the position P2 and vise versa. In a space between the positions P1 and P3 there is provided a nozzle recovery unit 20 which when opposed to the line head 12 can act to purge away soil from its ink nozzles and thereby to recover their printing function.

In the inkjet recording apparatus constructed as mentioned above, a jig A for detaching the line head chassis is provided in a region of the end of movement of the inkjet head 2*a*, . . . , 2*d* towards the prime mover and is in part detachable.

This line head chassis detachably attaching jig A is provided in a region on the side of the prime mover from each set position of the inkjet head 2*a*, . . . , 2*d*, and comprises a first support member 22 disposed on the upper surface of a auxiliary table 21 on which the nozzle recovery unit 20 is mounted, a second support member 23 mounted to an auxiliary flame 21*a* projecting outwards toward the prime mover from the an lower end portion of the auxiliary table 21, a rail member 24 whose one end is detachably engaged with the first support member 22, an upright support member 25 whose one end is detachably engaged with the second support member 23 and whose other end is rotatably connected to the other end of the rail member 24 and which is upright as a whole, a movable table unit 26 movably mounted on the rail member 24, and a head catch trey 27 mounted on the movable table unit 26.

Figure 4:
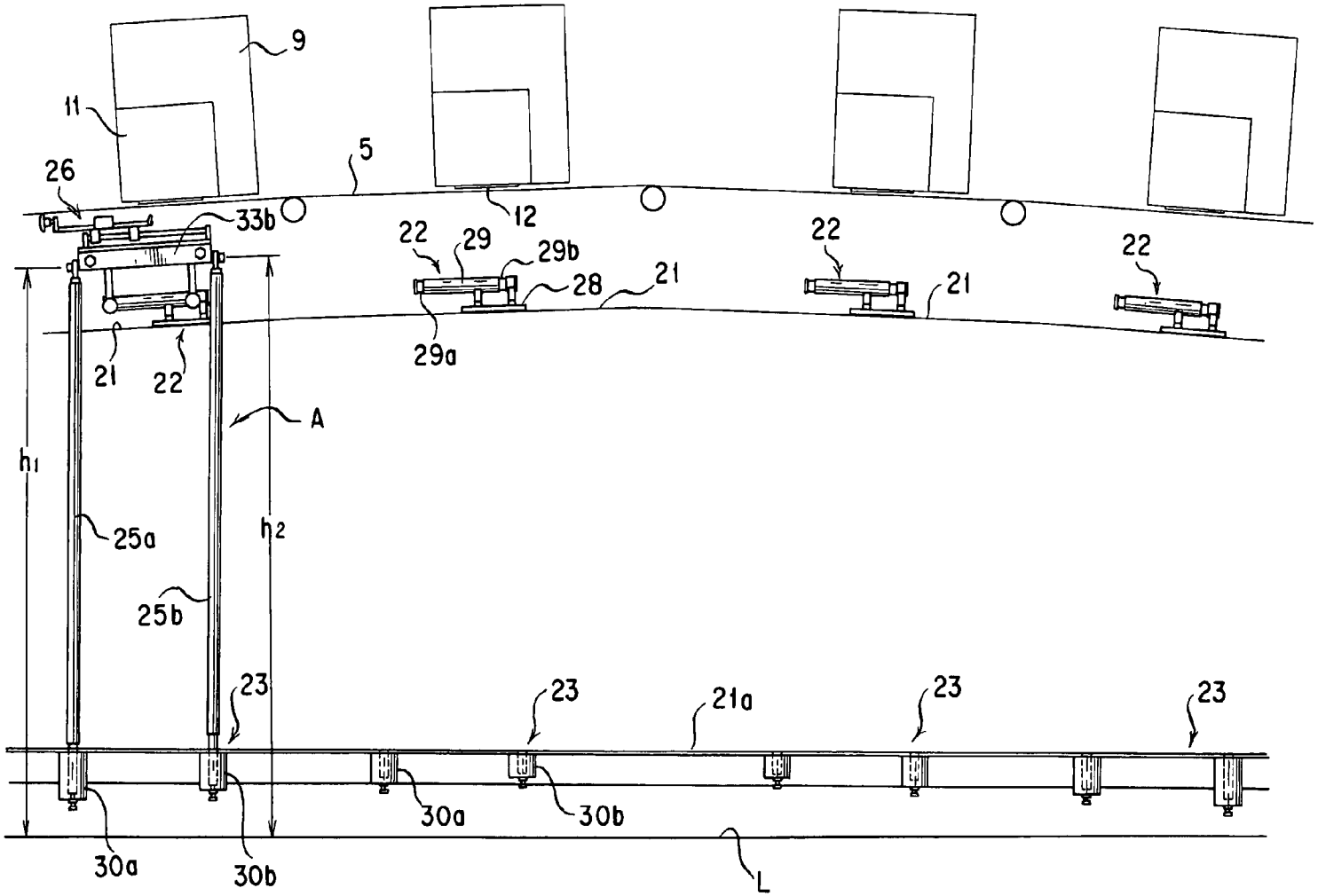
FIG. 4 is a front view illustrating the line head chassis detachably attaching jig of FIG. 3 together with a first and a second support member mounted corresponding to each inkjet head.

Each auxiliary table 21 corresponding to each inkjet head 2*a*, . . . , 2*d* as shown in FIG. 4 lies parallel to the lower surface of the line head 12 of each inkjet head 2*a*, . . . , 2*d*.

The first support member 22 comprises a bracket 28 fastened to the auxiliary table 21 and a support bar 29 secured to the bracket 28 to lie in a direction in which the paper 5 travels and which is parallel to the auxiliary table 28. The support bar 29 used is a round bar and is formed at two places axially with grooves 29*a* and 29*b*, respectively.

Figure 5:
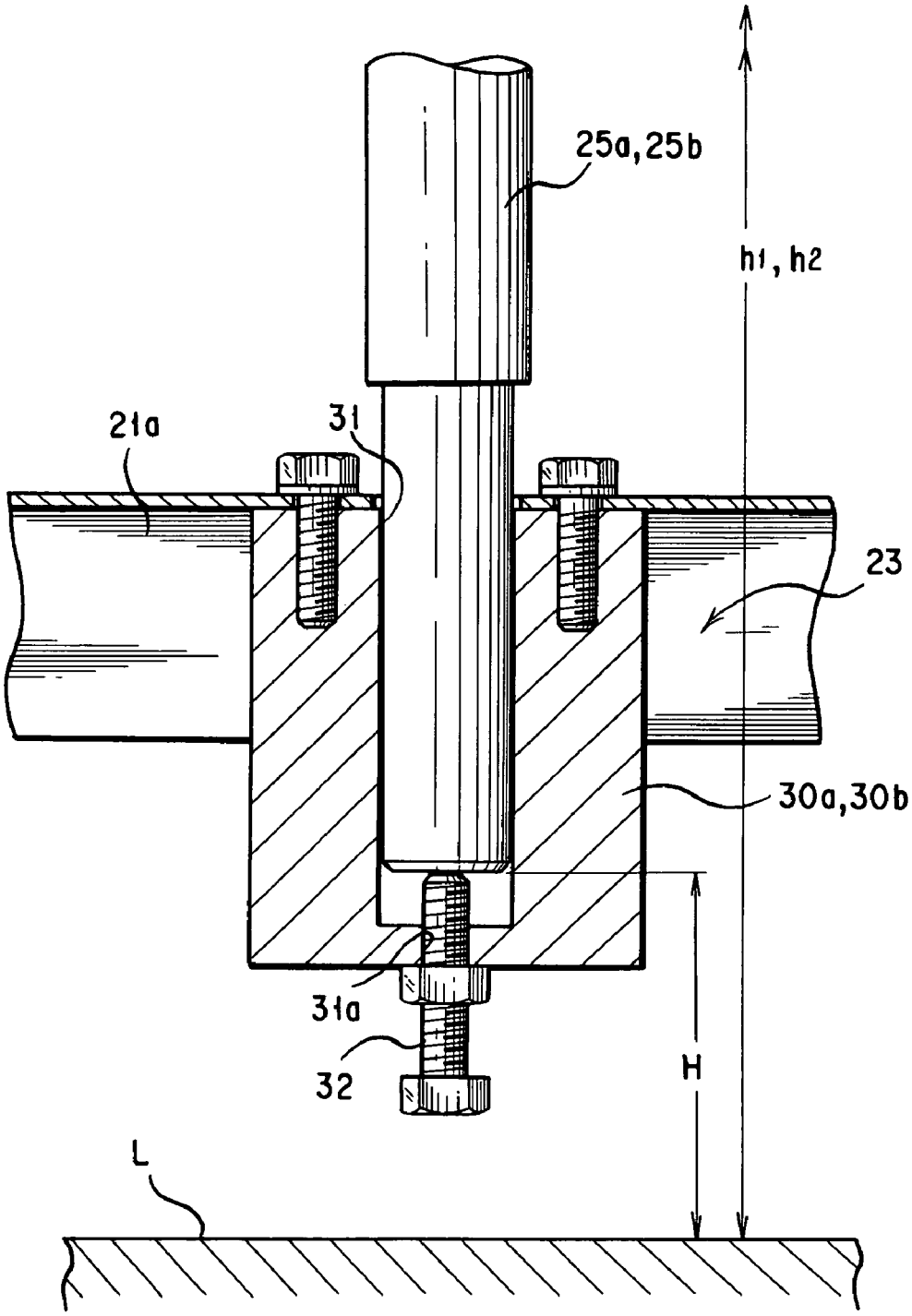
FIG. 5 is a cross sectional view illustrating the second support member shown in FIG. 4.

The second support member 23 comprises two support fittings 30*a* and 30*b* which are each vertical and positioned side by side in a direction in which the paper 5 travels. The support fittings 30*a* and 30*b* as shown in FIG. 5 are each formed with a threaded part 31*a* in the lower end of a hole 31, with which a bolt 32 is engaged facing upwards within the hole 31 of the support fitting 30*a*, 30*b*. It is designed that changing the position of thread engagement of the bolt 32 changes the height H of its end from a floor L.

Figure 6:
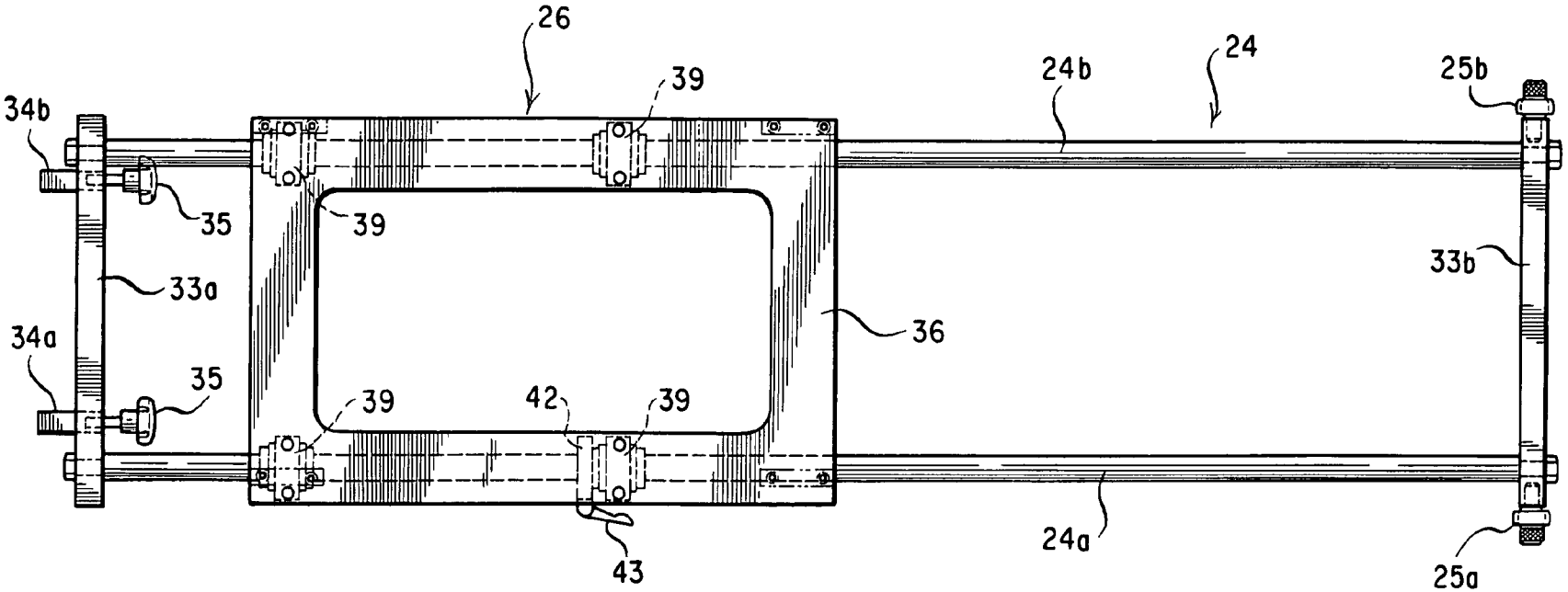
FIG. 6 is a view taken along the line VI-VI and seen in a direction of the arrow in FIG. 3.

The rail member 24 is as shown in FIGS. 3 and 6, and comprises a pair of parallel rails 24*a* and 24*b* whose respective first and second ends are interconnected by a first and a second coupling fittings 33*a* and 33*b*, respectively. And, the coupling fitting 33*a* at the first end is provided below it at two places in a direction orthogonal to the rails 24*a* and 24*b* with engagement pieces 34*a* and 34*b* having at their lower ends yoke portions for engagement from the upside with the grooves 29*a* and 29*b* formed in the support bar 29 of the first support member 22. These engagement pieces 34*a* and 34*b* have their ends provided with thrust screws 35 in a direction in which to close the yoke portions. It is designed that screwing the thrust screws 35 fastens the engagement pieces 34*a* and 34*b* engaged with the grooves 29*a* and 29*b* of the support bar 29.

The upright support members 25 are as shown in FIGS. 3 and 4 and comprises a pair of posts 25*a* and 25*b* rotatably connected to both ends of the other coupling fitting 33*b* of the rail member 24. These two posts 25*a* and 25*b* are spaced apart at a distance that is identical to spacing between the support fittings 30*a* and 30*b* of the second support member 23, and adapted to have their respective lower ends releasably inserted in the holes 31 of the support fittings 30*a* and 30*b*, respectively. And, the lower ends of the posts 25*a* and 25*b* are allowed to come in contact with the ends of the bolts 32 in the support fittings 30*a* and 30*b*, respectively, to set up the depth of insertion, by which these posts are inserted. Thus, the depth of thread engagement of the bolt 32 can be variably adjusted to variably adjust the height H to its end from the floor L, thereby adjusting the height $h_1$, $h_2$ from the floor L to a point where the posts 25*a* and 25*b* are connected to the coupling fitting 33*b* of the rail member 24.

It should be noted here that then, the top surface of the auxiliary table 21 which supports the first support member 22 lies parallel to the paper conveyance line along which the paper 5 travels on the underside of the corresponding inkjet head 2*a* and is not necessarily horizontal; therefore, the support bar 29 of the first support member 22 mounted thereon lies also parallel to the top surface of the auxiliary table 21 and is not horizontal, either. And, the rail member 24 whose one end portion is supported by the support bar 29 of the first support member 22 must be mounted parallel to the top surface of the auxiliary table 21, requiring that the height $h_1$, $h_2$ from the floor L to the tops of the two posts 25*a* and 25*b* which make up the upright support member 25 supporting the other end portion of the rail member be varied correspondingly. This height adjustment is made by the bolt 32 for the support fittings 30*a* and 30*b*.

The top ends of the posts 25*a* and 25*b* which make up the upright support member 25 are rotatably coupled to the other coupling fitting 33*b* of the rail member 24 and are thereby foldable. To mention further, the above coupling may be made detachable.

Figure 7:
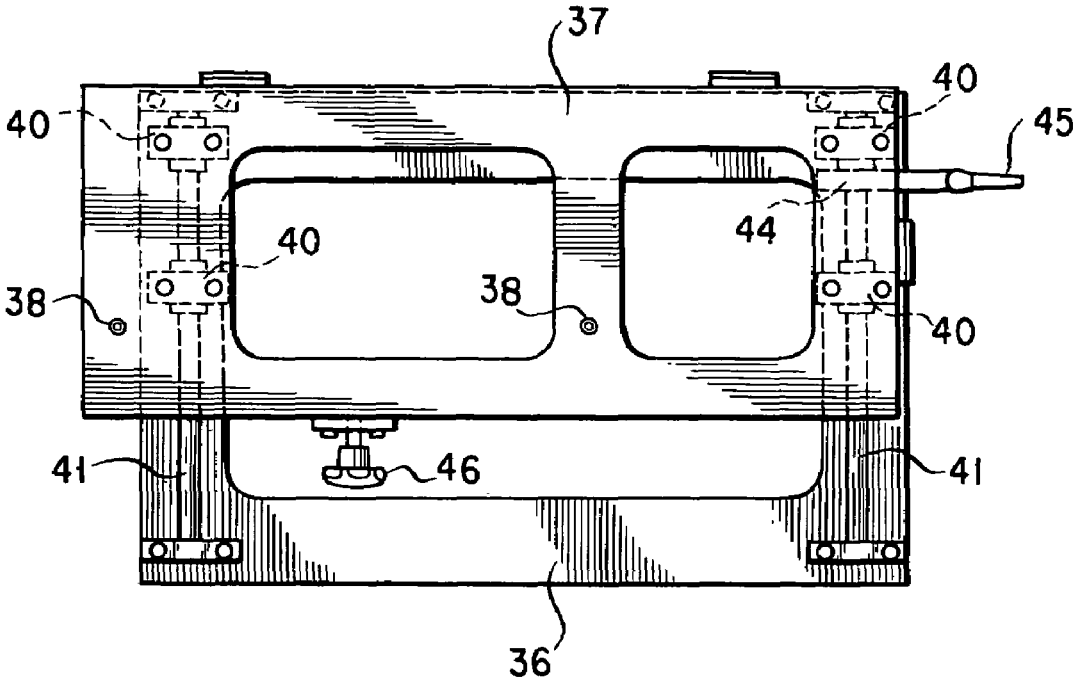
FIG. 7 is a view taken along the line VII-VII and seen in a direction of the arrow in FIG. 3.
Figure 8:
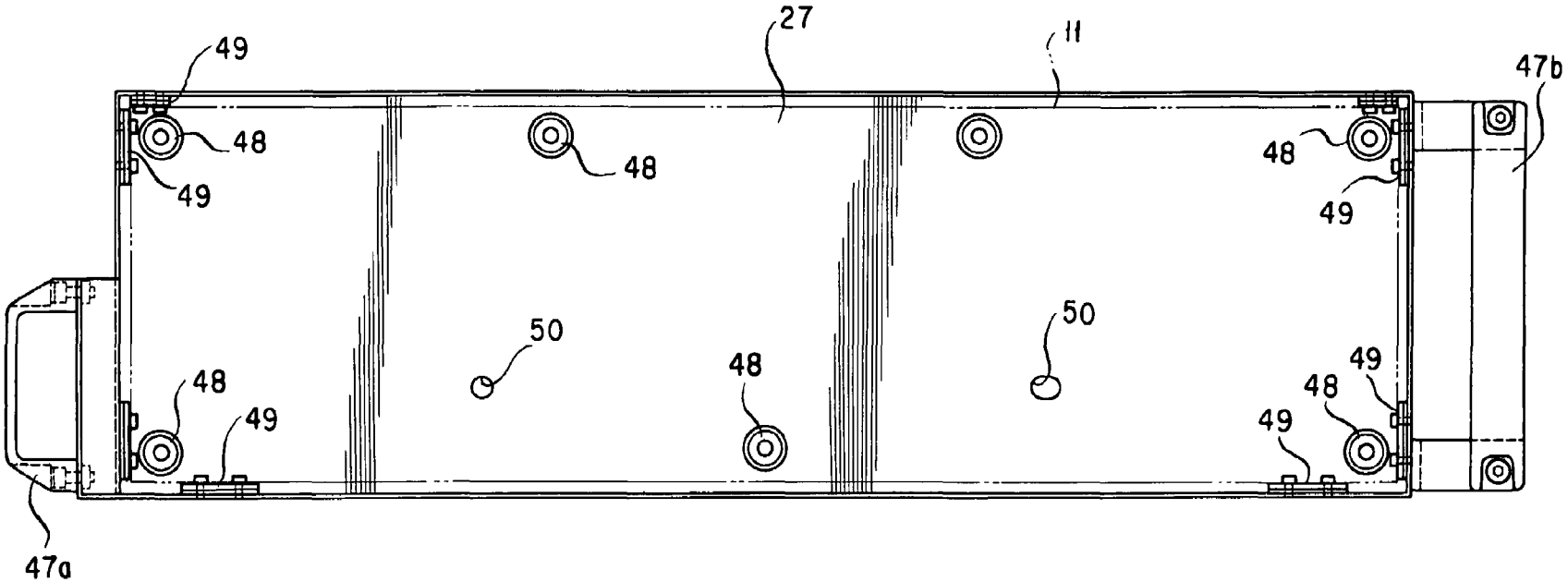
FIG. 8 is a plan view illustrating a head catch tray for the line head chassis detachably attaching jig shown in FIGS. 3 and 4.
Figure 9:
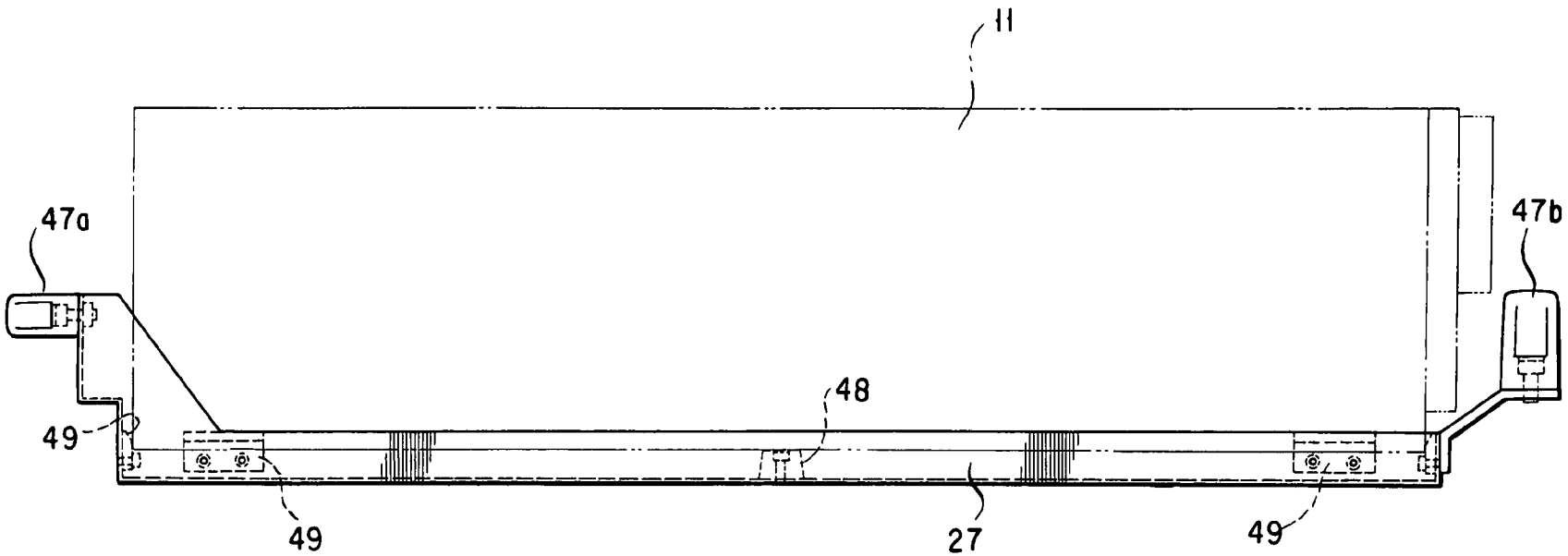
FIG. 9 is a front view illustrating the head catch tray of FIGS. 3-8.
Figure 10:
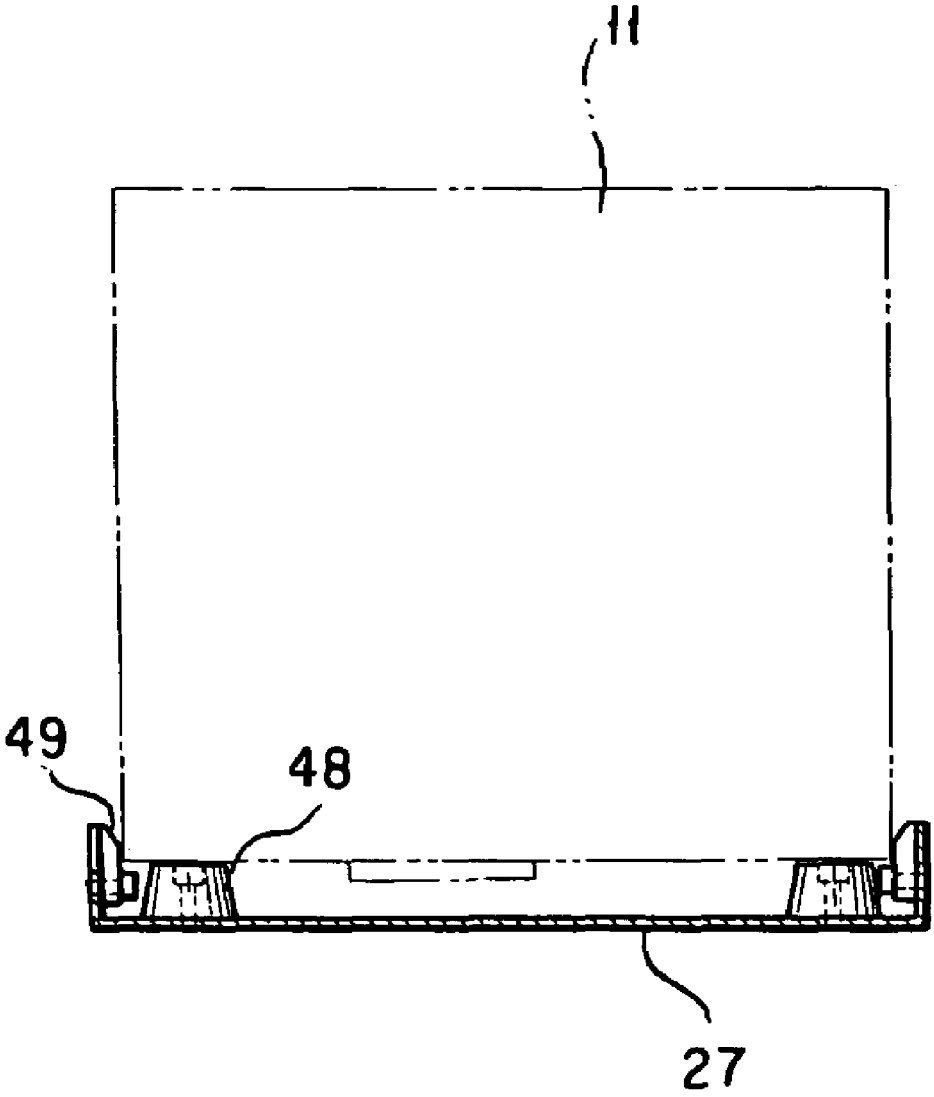
FIG. 10 is a cross sectional view illustrating the head catch tray of FIGS. 3-9.
Figure 11:
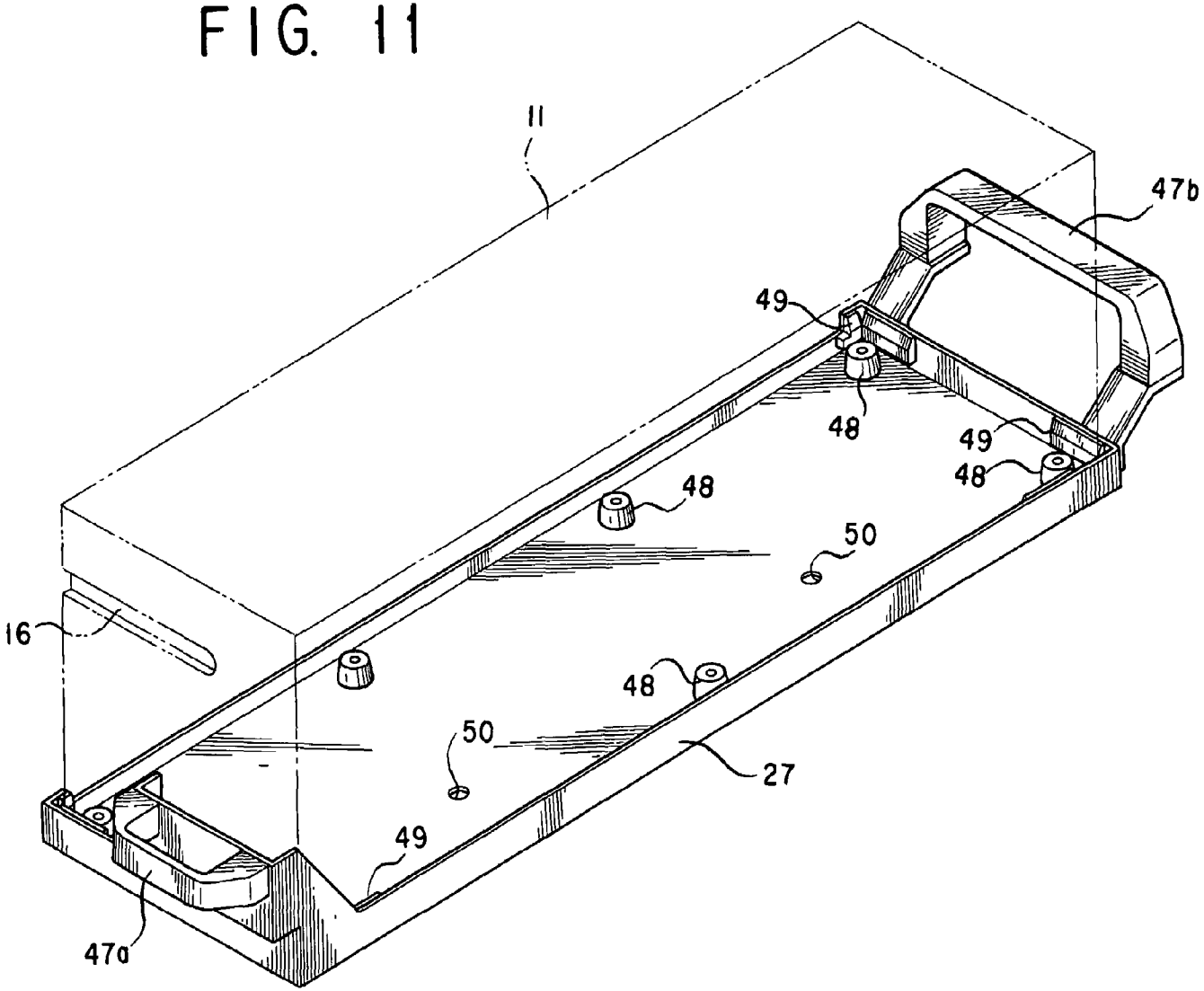
FIG. 11 is a perspective view illustrating the head catch tray of FIGS. 3-10.

The movable table unit 26 are as shown in FIGS. 3, 6 and 7 and comprises a base table 36 mounted on the rail member 24 so as to be movable on its rails 24*a* and 24*b*, and a cradle 37 mounted on the base table 26 so as to be movable in a direction orthogonal to the direction in which the base table 36 moves. The cradle 37 has thereon a plurality of positioning pins 38 projecting thereon. In FIG. 6 which is a view taken along the line VI-VI and seen in a direction of the arrow in FIG. 3, the cradle 37 is omitted.

The base table 36 is moved on the rain member 24 through bearings 39, 39 provided on the underside of the base table 36 to slidably fit with the rails 24*a* and 24*b*. On the other hand, the cradle 37 is moved through a pair of bearings 40 and 40 provided on its underside to slidably fit with a pair of rails 41 and 41, respectively, which are laid on the base table 36 in a direction orthogonal to the direction in which the base table 36 moves.

The base table 36 of the movable table unit 26 is provided on its under surface with a slotted member 42 for fitting with one rail 24*a* of the rail member 24 and a threaded handle 43 for tightening the slotted member 42 such that the movable table unit 26 can be fixed at a desired position on the rail member 24.

The cradle 37 of the movable table unit 26 is provided on its under surface with a slotted member 44 for fitting with one rail 41 of the rails 41 and 41 on the base table 36 and a threaded handle 45 for tightening the slotted member 44 such that the cradle 37 can be fixed at a desired position on the base table 36. The cradle 37 is also provided at one side with a set screw 46 for contact with a side face of the head catch tray 27 when mounted on the cradle 37 to fix the same.

The head catch tray 27 is adapted to be placed on the cradle 37 of the movable table unit 26 upon engaging with the positioning pins 38 projecting on the cradle 37 for positioning.

The head catch tray 27 as shown in FIGS. 8-11 is designed to place thereon the line head chassis 11 with the line head 12 lying at its underside and is provided at its both sides with hand holds 47*a* and 47*b*. As regards these hand holds 47*a* and 47*b*, it should be noted that one hand hold 47*a* lying at the upstream side (FIG. 8, the left hand side) in the direction in which the movable table unit 26 moves is made small so that it does not interfere with the line head chassis 11 loaded.

The head catch tray 27 is provided at a plurality of places on its bottom face with cushions 48 for receiving the undersurface of the line head chassis 11. Also, the head catch tray 27 is provided at a plurality of places circumferentially on its inner walls with guide pieces 49 for closely guiding the peripheral surfaces of the line head chassis 11 moving downwards. Also, its base plate is formed with positioning pin holes 50 and 50 to be engaged with the positioning pins 38 and 38 formed in the cradle 37.

Mention is next made of an operation of the line head chassis detachably attaching jig A constructed as mentioned above.

Of those of a plurality of inkjet heads 2*a*, . . . , 2*d* as shown in FIG. 1 as arranged along the paper conveyance line, let it be assumed that the line head chassis 11 of, say, the downstream-most inkjet head 2*d* is detached from the controller housing 9. Then, as shown in FIGS. 3 and 4, the rail member 24 and the upright support member 25 of the line head chassis detachably attaching jig A are used and engaged with the first and second members 22 and 23 provided for the auxiliary table 21 and the auxiliary frame 21*a* which are positioned to correspond to the inkjet head 2*d*.

In this line head chassis detachably attaching jig A, first the engagement pieces 34*a* and 34*b* provided for one of the coupling fitting, 33*a*, of the first rail member 24 is engaged with the grooves 29*a* and 29*b* of the support bar 29 of the first support member 22 provided for the auxiliary table 21 and are fixed fast by the thrust screws 35, respectively, and thereby fixed to the first support member 22 there. Before or after this, the lower ends of the posts 25*a* and 25*b* of the upright support member 25 are inserted into the holes 31 of the support fittings 30*a* and 30*b* of the second support member 23, respectively and then fixed fast there.

The lower ends of the posts 25*a* and 25*b* then come into contact with the ends of the bolts 32 provided at the lower part of the support fittings 30*a* and 30*b*, respectively, and thereby supported. Then, by adjusting the length of protrusion of each bolt 32 into the hole 31, the height $h_1$, $h_2$ from the floor L to the top end of each post 25*a*, 25*b* is adjusted so that the other coupling fitting 33*b* of the rail member 24 becomes parallel to one coupling fitting 33*a*.

In this state, the movable table unit 26 of the line head chassis detachably attaching jig A is supported to lie parallel to the under surface of the line head chassis 11. Then, the base table 36 of the movable table unit 26 is positioned at an outward stroke end towards the prime mover of the inkjet head 2*d*, and the cradle 37 is positioned at a stroke end away from the controller housing 9 (downstream of travel of the paper 5), where they are fixed fast by fastening tight the slotted members 42 and 44 with the threaded handles 43 and 45, respectively. The head catch tray 27 is positioned by engagement of the positioning pins 38 with the positioning pin holes 50.

Then, the controller housing 9 is moved to the maintenance position $P_2$. Thereafter, the movable table unit 26 upon releasing fixa-fixation of the base table 36 is moved to the maintenance position where it is fixed fast again. And, the cradle 37 upon releasing its fixation in this state is moved towards the controller housing 9, and the catch tray 27 mounted on the cradle 37 is positioned below the line head chassis 11 where the cradle 37 is fixed fast again.

Figure 12:
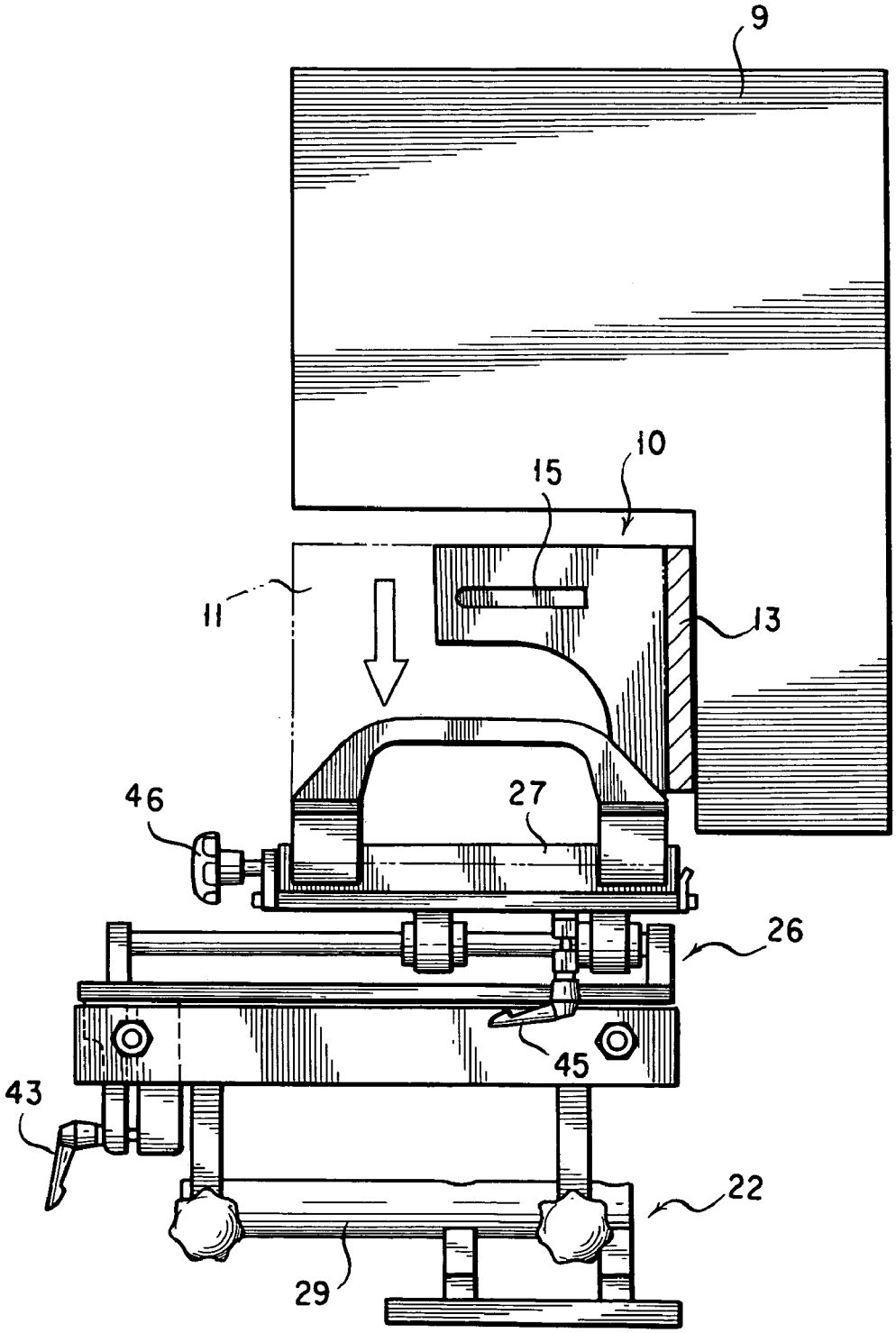
FIG. 12 is a front view illustrating that the line head chassis detachably attaching jig shown in FIGS. 3-11 is used.

Subsequently, the line head chassis 11 is disengaged from the controller housing 9, and the elevating unit 14 is operated to move the line head chassis 11 down to place it on the catch tray 27 (FIG. 12). The line head chassis 11 is then guided with the guide pieces 49 provided circumferentially on the inner wall of the head catch tray 27 and thereby seated smoothly in the catch tray 27.

Figure 13:
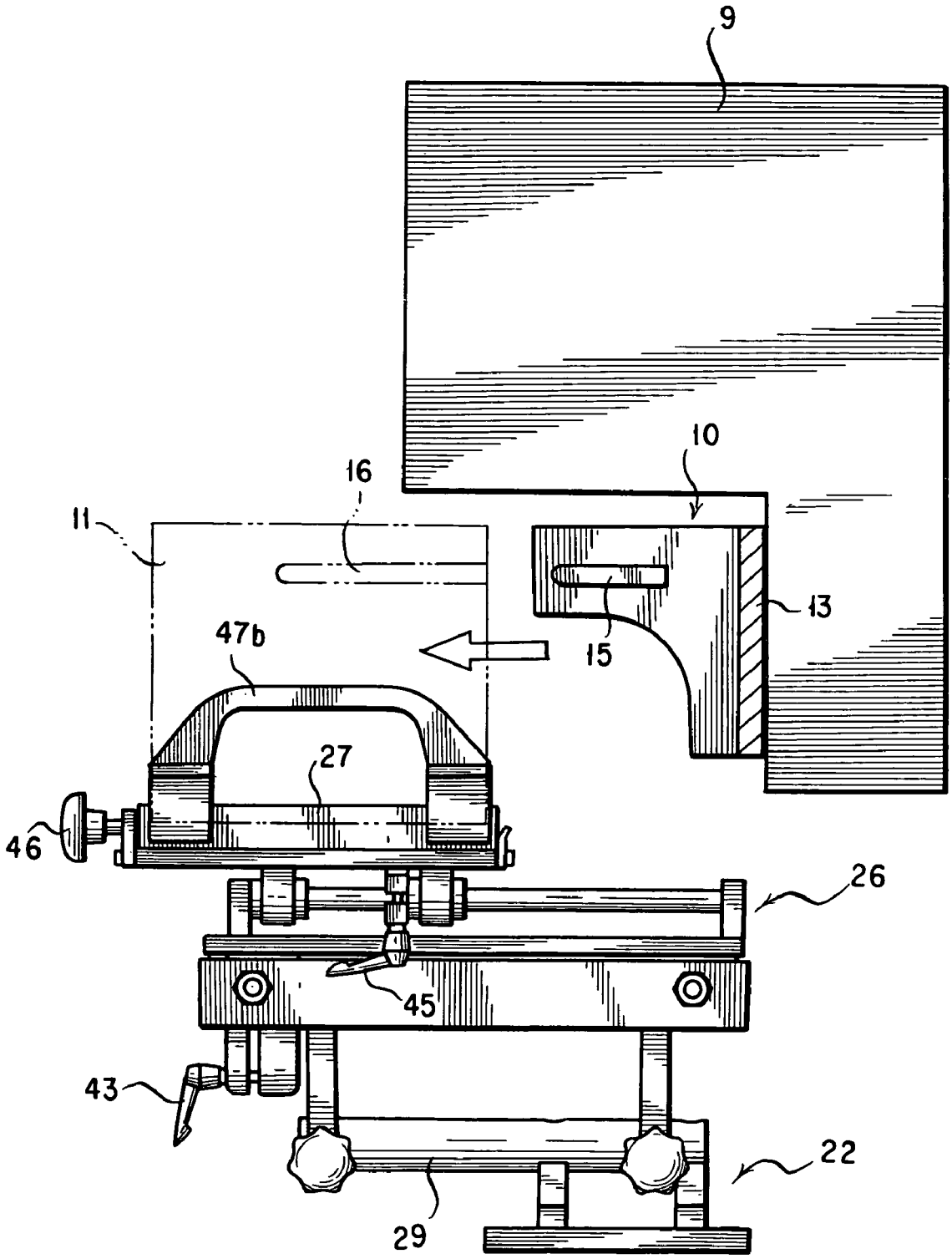
FIG. 13 is a front view illustrating the line head chassis detachably attaching jig of FIG. 3-11 in which the catch tray is shown in the state that it has been moved from the position shown FIG. 12.

In this state, the head catch tray 27 is taken out and the line head chassis 11 is removed from the bracket 13 of the controller 9 FIG. 13).

Subsequently, the movable table unit 26 is moved outwards towards the prime mover and fixed fast again, and in this state, the set screw 46 is loosened. Then, the head catch tray 27 is carried with hands holding the handles 47*a* and 47*b* and together with the line head chassis 11 is taken out of the movable table unit 26 and moved onto a workbench (not shown). And, there the line head chassis 11 is taken out of the head catch tray 27 and maintained. Alternatively, the line head chassis 11 is replaced with a new line head chassis 11.

In loading the line head chassis 11 onto the controller housing 9, the operations mentioned above are reversed.

In the form of implementation mentioned above, the head catch tray 27 may be provided with a clamp to fasten the line head chassis 11 as mounted on the head catch tray 27.

The line head chassis detachably attaching jig A not in use may be left as it is loaded on the side of the prime mover of the inkjet head, but instead its members other than the first and second members 22 and 23 may be removed from the first and second members 22 and 23 and stored separately.

The rail member 24 and the upright support member 25 when so stored are folded and can thus be stored in a limited space.

In this manner, the line head chassis detachably attaching jig A according to the present invention is mounted at the side of the prime mover of each inkjet head where its line head chassis 11 is to be maintained and, the line head chassis 11 is then detached and attached.

While the inkjet heads 2*a*-2*d* in the printing section 2 then lie individually parallel to the surface along which the paper 5 travels and the respective line head chassis bodies 11 of the heads are different from each other in the posture they take and in the height their lower surfaces have from the floor, the members of the line head chassis detachably attaching jig A according to the present invention except the first and second support members 22 and 23 can freely be used in common without the need to make any particular adjustment for the inkjet heads 2*a*-2*d* by virtue of the fact that the posture of the rail member 24 and its height h from the floor outside can be adjusted for the second support member 23 supporting the upright support member 25 and the rail member 24 can be detached from and attached to the first support member 22 provided corresponding to each individual inkjet head 2*a*, . . . , 2*d*.

Also, while the support bar 29 of the first support member 22 is shown positioned parallel to the auxiliary table 21 for each individual inkjet head 2*a*, . . . , 2*d*, the support bar 29 can be fastened to the bracket 28 so as to make its position adjustable while making it possible to adjust an installation error of the bracket 28 and the support bar 29 with respect to the auxiliary table 21.

Further, while the form of implementation illustrated is shown to position the catch tray 27 on the cradle 37 for engagement and disengagement and then to place the line head chassis 11 on the catch tray 27, the line head chassis 11 may directly be placed on and engaged with the cradle 37 without using the catch tray 27.

What is claimed is:

1. In an inkjet recording apparatus having an inkjet head comprising a controller housing that can be moved between a printing position and a maintenance position lateral to the printing position and a line head chassis that can be attached to and detached from the controller housing, a jig for the line head chassis characterized in that the jig comprises a first support member mounted on a table lateral to the inkjet head; a second support member mounted laterally to and lower than said first support member; a rail member mounted laterally to said first support member and having one end connected thereto; an upright support member having its lower end supported by said second support member adjustably in its height direction and its upper end connected to the other end of said rail member for supporting said rail member horizontally; a base table slidably supported on said rail member to move over a distance outward from said maintenance position; and a cradle means supported on said base table so as to be movable perpendicularly to a direction in which said base table moves for accepting the line head chassis, wherein one end of said rail member and the lower end of said upright support member are made engageable with/disengageable from, said first and second support members, respectively.

2. A jig for the line head chassis in an inkjet recording apparatus as set forth in claim 1, characterized in that a head catch tray for accepting said line head chassis is mounted on said cradle means so that it can be engaged with and disengaged from the latter.

* * * * *